US007428309B2

(12) United States Patent
Malvar et al.

(10) Patent No.: US 7,428,309 B2
(45) Date of Patent: Sep. 23, 2008

(54) ANALOG PREAMPLIFIER MEASUREMENT FOR A MICROPHONE ARRAY

(75) Inventors: Henrique Malvar, Sammamish, WA (US); Ivan Tashev, Kirkland, WA (US)

(73) Assignee: Microsoft Corporation, Redmond, WA (US)

( * ) Notice: Subject to any disclaimer, the term of this patent is extended or adjusted under 35 U.S.C. 154(b) by 785 days.

(21) Appl. No.: 10/772,528

(22) Filed: Feb. 4, 2004

(65) Prior Publication Data

US 2005/0169483 A1 Aug. 4, 2005

(51) Int. Cl.
*H04R 29/00* (2006.01)
*H04R 3/00* (2006.01)

(52) U.S. Cl. ..... 381/58; 381/92

(58) Field of Classification Search ..... 381/58, 381/56, 111, 112, 113, 114, 115, 122, 120, 381/92, 98; 73/1.82, 659; 367/135
See application file for complete search history.

(56) References Cited

U.S. PATENT DOCUMENTS 5,029,215 A * 7/1991 Miller, II ..... 381/58
5,125,260 A * 6/1992 Hedeen ..... 73/1.82
6,058,076 A * 5/2000 Komninos ..... 367/135
6,487,574 B1 11/2002 Malvar
6,496,795 B1 12/2002 Malvar

OTHER PUBLICATIONS

S. Nordholm, I. Claesson, M. Dahl. "Adaptive microphone array employing calibration signals; an analytical evaluation". IEEE Trans. on Speech and Audio Processing, vol. 7, pp. 241-252, May 1999.

D. A. Florêncio and H. S. Malvar, "Multichannel filtering for optimum noise reduction in microphone arrays," Proc. International Conference on Acoustic, Speech, and Signal Processing, pp. 197-200, May 2001.

M. Seltzer, B. Raj. "Calibration of Microphone arrays for improved speech recognition". Mitsubishi Research Laboratories Technical Report, TR-2001-43, Dec. 2001.

H. Teutsch and G. Elko. "An adaptive close-talking microphone array," Proc. IEEE Workshop on Applications of Signal Processing to Audio and Acoustics, pp. 163-166, Oct. 2001.

H. Wang and P. Chu, "Voice source localization for automatic camera pointing system in videoconferencing," Proc. International Conference on Acoustic, Speech, and Signal Processing, pp. 187-190, Apr. 1997.

R. Duraiswami, D. Zotkin, and L. S. Davis, "Active speech source localization by a dual coarse-to-fine search," Proc. International Conference on Acoustic, Speech, and Signal Processing, pp. 3309-3312, May 2001.

* cited by examiner

*Primary Examiner*—Ping Lee
(74) *Attorney, Agent, or Firm*—Lyon & Harr, LLP; Mark A. Watson

(57) ABSTRACT

An analog preamplifier measurement system for a microphone array builds on conventional microphone arrays by providing an integral "self-calibration system." This self-calibration system automatically injects an excitation pulse of a known magnitude and phase to all preamplifier inputs within the microphone array. The resulting analog waveform from each preamplifier output is then measured. A frequency analysis, such as, for example, a Fourier or Fast Fourier Transform (FFT), or other conventional frequency analysis, of each of the resulting waveforms is then performed. The results of this frequency analysis are then used to automatically compute frequency-domain compensation gains (e.g., magnitude and phase gains) for each preamplifier for matching or balancing the responses of all of the preamplifiers with each other.

20 Claims, 10 Drawing Sheets

ANALOG PREAMPLIFIER MEASUREMENT FOR A MICROPHONE ARRAY

BACKGROUND

1. Technical Field

The invention is related to a microphone array preamplifier measurement system, and in particular, to a system and method for automatically determining gain variations between one or more analog microphone/preamplifier channels in a microphone array and a system and method for automatically compensating for such gain variations to provide for improved processing of audio signals captured via the microphone array.

2. Related Art

Conventional microphone array type devices are well known to those skilled in the art. In general, microphone arrays typically include an arrangement of microphones in some predetermined layout. These microphones are generally used to capture sounds from various directions and originating from different points of the space. Once captured, onboard sound processing software and hardware then provides sound processing capabilities, such as, for example, sound source localization, beam forming, acoustic echo cancellation, noise suppression, etc.

For example, one common use for such arrays involving audio conferencing systems is to determine the direction of a dominant speaker in a room having both active speech and other noise, and then to process the input from the various microphones in the array accordingly. In particular, given the input from each of the microphones in the array, conventional beam forming and sound source localization computations are used to localize the position and direction of the person currently speaking. With this information, it is then possible to filter out all sounds not coming from the direction of the speaker, thereby improving the overall quality of the captured sound with respect to the person speaking.

In general, such microphone arrays typically include one or more sets of matched microphone/preamplifier combinations. In other words, the electronic components, i.e., microphones, preamplifier circuits, etc., within such microphone arrays are carefully chosen so that that the frequency responses of the various microphone/preamplifier combinations within the microphone array are as close as possible to one another for any particular audio input. Matching the gains and frequency responses among the preamplifier circuits is important because variations across channels degrade the performance of the aforementioned beam forming and sound source localization algorithms.

Unfortunately, choosing electronic components for matching the frequency response of the various microphone/preamplifier combinations within a microphone array is typically rather expensive, thereby increasing the cost of such microphone arrays. For example, choosing electronic components with matching responses is typically accomplished either through the careful testing of a large batch of individual electronic components to identify those with matching properties, or through the use of relatively expensive high-precision electronic components (capacitors, resistors, op amps, etc.) that are guaranteed to have particular electrical properties within some small tolerance. Both cases tend to significantly increase the cost of matched sets of microphone/preamplifier combinations for a microphone array.

Further, in the case where inexpensive electronic components of some nominal tolerance are used there will likely be a relatively wide variation in the frequency response of each microphone/preamplifier combination within the microphone array. As a result, in order to achieve optimal audio processing performance, the response of each individual microphone/preamplifier combination within the microphone array must be pre-determined, and any software designed to process audio signals captured by the microphone array must then be specifically tailored to the specific operational parameters of each microphone/preamplifier combination within that array. Consequently, each such microphone array typically requires customized software, thereby increasing both test time and cost to manufacture individual microphone arrays.

Further, the operational parameters of individual electronic components in a microphone array tend to change, if even only slightly, over time, and relative to the local temperature of such electronic components. Therefore, software tailored to a particular microphone array configuration may still produce sub-optimal audio processing results where the parameters of the microphone array fail to precisely match the expected operational parameters coded into any associated audio processing software or hardware.

Therefore, what is needed is a system and method for allowing a microphone array to avoid the use of expensive matched electronic components by allowing for the use of relatively less expensive non-matched electronic components. Further, rather than requiring software to be specifically pre-tailored to the particular operational parameters of each microphone/preamplifier combination within the array, the microphone array should instead be operable with software that automatically configures itself to the operational parameters of the microphone array. Consequently, such a system and method should automatically determine and compensate for variations in the gain and frequency response of each microphone/preamplifier combination within the array to allow for automatic configuration and optimization of audio processing software associated with the microphone array.

SUMMARY

As is well known to those skilled in the art, conventional microphone arrays typically include an arrangement of one or more microphones in some predetermined layout. In general, each microphone in these arrays typically includes an associated preamplifier for providing amplification or gain for analog audio signals captured by each microphone. Further, each of the input channels (i.e., each microphone/preamplifier combination) of such microphone arrays are typically matched so that that the sensitivity and frequency responses of those input channels are as close as possible to one another for any particular audio input. However, providing for matched components in a microphone array tends to increase both cost and test time when manufacturing such arrays.

Therefore, in contrast to conventional microphone arrays, an analog preamplifier measurement system for a microphone array, as described herein, operates to solve the problems identified above by providing a modified microphone array with an integral "self-calibration system." In general, this integral self-calibration system automatically determines frequency-domain responses of each preamplifier in the microphone array, and computes frequency-domain compensation gains, so that digital signal processing applications can use those compensation gains for matching the output of each preamplifier. As a result, there is no need to predetermine exact operational characteristics of each channel of the microphone array, or to use expensive matched electronic components.

Further, as is well known to those skilled in the art, individual microphone operational characteristics, as well as the characteristics of most other electrical components, tend to change both over time and as a function of local temperature. Consequently, use of the integral self-calibration system provides current operational parameters of the microphones and associated preamplifiers within the microphone array which better reflect actual component parameters than factory measured values which are typically coded into conventional microphone arrays or audio processing software.

In operation, the integral self-calibration system injects excitation pulses of a known magnitude and phase to all preamplifier inputs within the microphone array. Note that the duration of the pulse should be larger than the preamplifier step response so as to avoid or minimize any effects resulting from transient responses. The resulting analog waveform from each preamplifier output is then measured. A frequency analysis, such as, for example, a Fourier or Fast Fourier Transform (FFT), or other conventional frequency analysis, of each of the resulting waveforms is then performed. The results of this frequency analysis are then used to compute frequency-domain compensation gains for each preamplifier for matching or balancing the responses of all of the preamplifiers with each other.

In one embodiment, the integral self-calibration system is included in a "self-descriptive microphone array," as described in a copending patent application entitled "SELF-DESCRIPTIVE MICROPHONE ARRAY," having a filing date of 9 Feb. 2004, and assigned application Ser. No. 10/775,371, the subject matter of which is incorporated herein by this reference. In this embodiment, the integral self-calibration system operates automatically either upon connection of the self-descriptive microphone array to the external computing device, upon regular or user-specified intervals, or upon command. In this embodiment the injection of pulses, readings of the preamplifier outputs, and computation of the frequency analysis, are all performed by driver software residing in the external computing device connected to the microphone array.

Once computed, these frequency-domain compensation gains can then be applied to the output of each corresponding preamplifier when processing actual audio inputs of the microphones associated with each preamplifier. This serves to make the output from each of the preamplifiers consistent, given the same or similar input to any of the microphones in the array. Consequently, using these computed frequency-domain compensation gains, audio processing software such as, for example, software for performing sound source localization, beam forming, acoustic echo cancellation, noise suppression, etc., can easily compensate for phase response mismatches across all preamplifiers. Without this compensation, any phase response mismatches would reduce the performance of the audio processing software.

Therefore, as a result of computing and providing these frequency-domain compensation gains for each preamplifier, there is no need to use expensive matched electrical components. Consequently, one advantage offered by the integral self-calibration system described herein is that microphone arrays using this integral self-calibration system may be inexpensively produced by using relatively inexpensive non-matched electrical components including, for example, transistors, capacitors, resistors, op amps, etc.

As noted above, the integral self-calibration system operates by first injecting a single pulse of a known magnitude and phase to each preamplifier. Then, as described above, the output of each preamplifier is then measured and used to compute frequency-domain compensation gains for each preamplifier. However, in another embodiment, multiple pulses of a known magnitude and phase are instead injected to each preamplifier. Then, for each preamplifier, the output resulting from each of the injected pulses is averaged. The averaged output of each preamplifier is then used to compute frequency-domain compensation gains for each preamplifier, as described above for the case of the single injected pulse.

In yet another embodiment, circuitry is included in the microphone array for automatically switching off the input from each microphone prior to inputting each the aforementioned pulse or pulses to each corresponding preamplifier. However, it has been observed that in the embodiment wherein multiple pulses are used along with an average of the preamplifier output, any noise resulting from allowing the microphones to remain active or live during pulse injection has a negligible effect on the computed frequency-domain compensation gains for each preamplifier, especially as the number of pulses increases.

As noted above, in one embodiment, the integral self-calibration system is included in a self-descriptive microphone array which makes use of external computing power for performing computations. In this embodiment, the frequency analysis for computing the frequency-domain compensation gains for each preamplifier is performed by an external computing device, such as a PC-type computer, or other computing device, coupled to the microphone array. One advantage of this embodiment is that because the microphone array makes use of external processing power, there is no need to include relatively expensive onboard signal processing software or hardware capabilities within the array itself. Consequently, the self-descriptive microphone array is relatively inexpensive to manufacture in comparison to conventional microphone array devices that include onboard audio processing capabilities. Note that the connection (a "microphone array interface") between the self-descriptive microphone array and the external computing device is accomplished using any of a variety of conventional wired or wireless computer interfaces, including, for example, serial, parallel, IEEE 1394, USB, IEEE 802.11, Bluetooth™, etc.

In another embodiment, as described in the aforementioned copending patent application entitled "SELF-DESCRIPTIVE MICROPHONE ARRAY," the microphone array further includes a "microphone array memory" that is integral to the microphone array. This microphone array memory includes any type of non-volatile memory, such as, for example a ROM, PROM, EPROM, EEPROM, or other conventional non-volatile memory type or device, which contains a microphone array device description. This device description includes parametric information, including the computed frequency-domain compensation gains for each preamplifier, which defines operational characteristics and configuration of the microphone array. In operation, the device description of the microphone array is automatically reported to the external computing device via the microphone array interface to the external computing device.

In this embodiment, once the microphone array device description is provided to the external computing device, the external computing device then uses the device description to automatically configure audio processing software residing within the external computing device for processing one or more audio signals captured by the microphone array. Specifically, software applications residing within the external computing device, such as dynamic link libraries (DLLs) or other software drivers or programs, interpret physical parameters of the microphone array, including the frequency-domain compensation gains, that are provided by the microphone array device description. These software applications then communicate the physical parameter data of the microphone array to signal processing software residing within the external computing device. This allows the signal processing software to automatically adjust its operational parameters to the characteristics of the attached microphone array to perform automatically optimized audio processing computations.

As noted above, preamplifiers are associated with each microphone in the microphone array. Further, to allow for multiple simultaneous channels of audio to be captured by the microphone array, one or analog-to-digital (A/D) converters are also associated with each microphone. Audio signals captured by the microphone array are then pre-amplified (i.e., gain) and converted to a digital signal via the A/D converters and provided, via the aforementioned wired or wireless computer interface, to the audio processing software residing within the external computing device for further processing, as desired. The maximum number of digital audio channels that can then be transmitted via the computer interface is then only limited by the maximum bandwidth of that computer interface in combination with the digital sampling rate of each channel of the microphone array.

In another embodiment, in addition to including one or more microphones, the microphone array also includes one or more loudspeakers for reproducing one or more audio signals. For example, many microphone arrays, such as those arrays used for audio conferencing, frequently include both microphones and speakers. The microphones capture sound, and the speakers play back sound. Generally, conventional audio conferencing-type microphone arrays also include relatively expensive onboard acoustic echo cancellation capabilities so that local audio signals are not endlessly echoed during an audio conference.

However, in the context of the aforementioned self-descriptive microphone array, audio processing, such as acoustic echo cancellation, is performed via the audio processing software residing within the external computing device. In this embodiment, audio to be played back via the self-descriptive microphone array is then simply transmitted from the external computing device to the array via the aforementioned wired or wireless computer interface.

In this embodiment, as with the parametric information defining the microphones and preamplifiers within the microphone array, parametric information defining the speakers within the microphone array is also stored within the microphone array memory. Configuration of the microphone array is then reported, as noted above, to allow for automatic configuration of the audio processing software residing within the external computing device to which the microphone array is connected.

In view of the above summary, it is clear that the integral self-calibration system for the microphone array provides a unique system and method for automatically determining frequency-domain compensation gains for each audio input channel within the array. In addition to the just described benefits, other advantages of the self-calibration system for the microphone array will become apparent from the detailed description which follows hereinafter when taken in conjunction with the accompanying drawing figures.

DESCRIPTION OF THE DRAWINGS

The specific features, aspects, and advantages of the present invention will become better understood with regard to the following description, appended claims, and accompanying drawings where:

DETAILED DESCRIPTION OF THE PREFERRED EMBODIMENTS

In the following description of the preferred embodiments of the present invention, reference is made to the accompanying drawings, which form a part hereof, and in which is shown by way of illustration specific embodiments in which the invention may be practiced. It is understood that other embodiments may be utilized and structural changes may be made without departing from the scope of the present invention.

Figure 1:
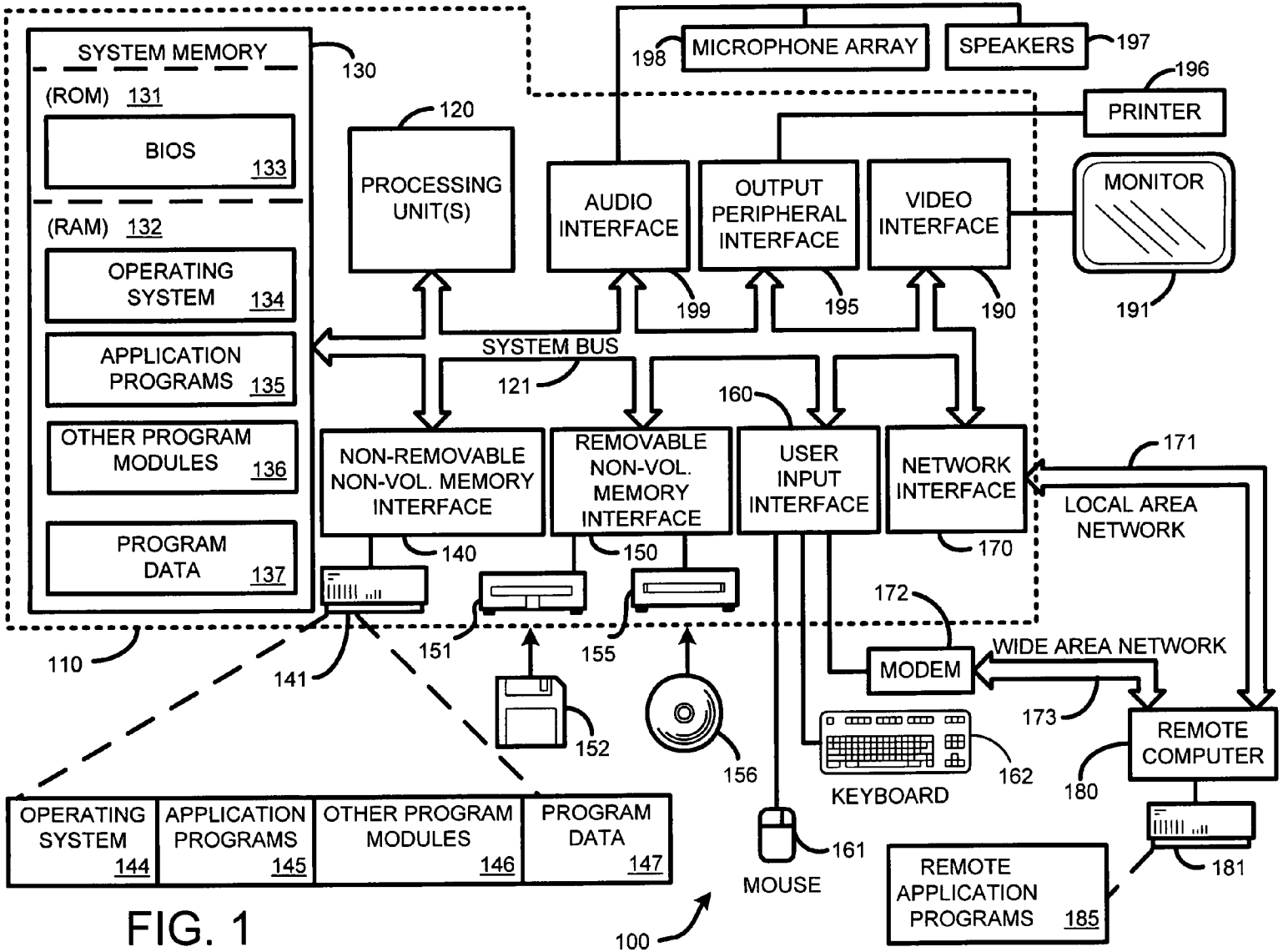
FIG. 1 is a general system diagram depicting a general-purpose computing device constituting an exemplary system for interfacing with a microphone array.

1.0 Exemplary Operating Environment:

FIG. 1 illustrates an example of a suitable computing system environment 100 with which the invention may be implemented. The computing system environment 100 is only one example of a suitable computing environment and is not intended to suggest any limitation as to the scope of use or functionality of the invention. Neither should the computing environment 100 be interpreted as having any dependency or requirement relating to any one or combination of components illustrated in the exemplary operating environment 100.

The invention is operational with numerous other general purpose or special purpose computing system environments or configurations. Examples of well known computing systems, environments, and/or configurations that may be suitable for use with the invention include, but are not limited to, personal computers, server computers, hand-held, laptop or mobile computer or communications devices such as cell phones and PDA's, multiprocessor systems, microprocessor-based systems, set top boxes, programmable consumer electronics, network PCs, minicomputers, mainframe computers, distributed computing environments that include any of the above systems or devices, and the like.

The invention may be described in the general context of computer-executable instructions, such as program modules, being executed by a computer in combination with hardware modules, including components of a microphone array 198. Generally, program modules include routines, programs, objects, components, data structures, etc., that perform particular tasks or implement particular abstract data types. The invention may also be practiced in distributed computing environments where tasks are performed by remote processing devices that are linked through a communications network. In a distributed computing environment, program modules may be located in both local and remote computer storage media including memory storage devices. With reference to FIG. 1, an exemplary system for implementing the invention includes a general-purpose computing device in the form of a computer 110.

Components of computer 110 may include, but are not limited to, a processing unit 120, a system memory 130, and a system bus 121 that couples various system components including the system memory to the processing unit 120. The system bus 121 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 110 typically includes a variety of computer readable media. Computer readable media can be any available media that can be accessed by computer 110 and includes both volatile and nonvolatile media, removable and non-removable media. By way of example, and not limitation, computer readable media may comprise computer storage media and communication media. Computer storage media includes volatile and nonvolatile removable and non-removable media implemented in any method or technology for storage of information such as computer readable instructions, data structures, program modules, or other data.

Computer storage media includes, but is not limited to, RAM, ROM, PROM, EPROM, EEPROM, flash memory, or other memory technology; CD-ROM, digital versatile disks (DVD), or other optical disk storage; magnetic cassettes, magnetic tape, magnetic disk storage, or other magnetic storage devices; or any other medium which can be used to store the desired information and which can be accessed by computer 110. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared, and other wireless media. Combinations of any of the above should also be included within the scope of computer readable media.

The system memory 130 includes computer storage media in the form of volatile and/or nonvolatile memory such as read only memory (ROM) 131 and random access memory (RAM) 132. A basic input/output system 133 (BIOS), containing the basic routines that help to transfer information between elements within computer 110, such as during start-up, is typically stored in ROM 131. RAM 132 typically contains data and/or program modules that are immediately accessible to and/or presently being operated on by processing unit 120. By way of example, and not limitation, FIG. 1 illustrates operating system 134, application programs 135, other program modules 136, and program data 137.

The computer 110 may also include other removable/non-removable, volatile/nonvolatile computer storage media. By way of example only, FIG. 1 illustrates a hard disk drive 141 that reads from or writes to non-removable, nonvolatile magnetic media, a magnetic disk drive 151 that reads from or writes to a removable, nonvolatile magnetic disk 152, and an optical disk drive 155 that reads from or writes to a removable, nonvolatile optical disk 156 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 141 is typically connected to the system bus 121 through a non-removable memory interface such as interface 140, and magnetic disk drive 151 and optical disk drive 155 are typically connected to the system bus 121 by a removable memory interface, such as interface 150.

The drives and their associated computer storage media discussed above and illustrated in FIG. 1, provide storage of computer readable instructions, data structures, program modules and other data for the computer 110. In FIG. 1, for example, hard disk drive 141 is illustrated as storing operating system 144, application programs 145, other program modules 146, and program data 147. Note that these components can either be the same as or different from operating system 134, application programs 135, other program modules 136, and program data 137. Operating system 144, application programs 145, other program modules 146, and program data 147 are given different numbers here to illustrate that, at a minimum, they are different copies. A user may enter commands and information into the computer 110 through input devices such as a keyboard 162 and pointing device 161, commonly referred to as a mouse, trackball, or touch pad.

Other input devices (not shown) may include a joystick, game pad, satellite dish, scanner, radio receiver, and a television or broadcast video receiver, or the like. These and other input devices are often connected to the processing unit 120 through a wired or wireless user input interface 160 that is coupled to the system bus 121, but may be connected by other conventional interface and bus structures, such as, for example, a parallel port, a game port, a universal serial bus (USB), an IEEE 1394 interface, a Bluetooth™ wireless interface, an IEEE 802.11 wireless interface, etc. Further, the computer 110 may also include a speech or audio input device, such as a microphone or a microphone array 198, as well as a loudspeaker 197 or other sound output device connected via an audio interface 199, again including conventional wired or wireless interfaces, such as, for example, parallel, serial, USB, IEEE 1394, Bluetooth™, etc.

A monitor 191 or other type of display device is also connected to the system bus 121 via an interface, such as a video interface 190. In addition to the monitor, computers may also include other peripheral output devices such as a printer 196, which may be connected through an output peripheral interface 195.

The computer 110 may operate in a networked environment using logical connections to one or more remote computers, such as a remote computer 180. The remote computer 180 may be a personal computer, a server, a router, a network PC, a peer device, or other common network node, and typically includes many or all of the elements described above relative to the computer 110, although only a memory storage device 181 has been illustrated in FIG. 1. The logical connections depicted in FIG. 1 include a local area network (LAN) 171 and a wide area network (WAN) 173, but may also include other networks. Such networking environments are commonplace in offices, enterprise-wide computer networks, intranets, and the Internet.

When used in a LAN networking environment, the computer 110 is connected to the LAN 171 through a network interface or adapter 170. When used in a WAN networking environment, the computer 110 typically includes a modem 172 or other means for establishing communications over the WAN 173, such as the Internet. The modem 172, which may be internal or external, may be connected to the system bus 121 via the user input interface 160, or other appropriate mechanism. In a networked environment, program modules depicted relative to the computer 110, or portions thereof, may be stored in the remote memory storage device. By way of example, and not limitation, FIG. 1 illustrates remote application programs 185 as residing on memory device 181. It will be appreciated that the network connections shown are exemplary and other means of establishing a communications link between the computers may be used.

The exemplary operating environment having now been discussed, the remaining part of this description will be devoted to a discussion of the hardware and software modules and processes embodying a self-calibration system and method for automatically determining frequency-domain compensation gains for each preamplifier in a microphone array.

2.0 Introduction:

Conventional microphone arrays typically include an arrangement of one or more microphones in some predetermined layout. In general, each microphone in these arrays typically includes an associated preamplifier for providing amplification or gain for analog audio signals captured by each microphone. An analog preamplifier measurement system for a microphone array, as described herein, builds on conventional microphone arrays by providing an integral "self-calibration system." In general, this integral self-calibration system automatically determines frequency-domain responses of each preamplifier in the microphone array, and computes frequency-domain compensation gains for matching the output of each preamplifier.

As a result, there is no need to predetermine exact operational characteristics of each channel of the microphone array, or to use expensive matched electronic components. Further, as is well known to those skilled in the art, individual microphone operational characteristics, as well as the characteristics of most other electrical components, tend to change both over time and as a function of local temperature. Consequently, use of the integral self-calibration system provides current operational parameters of the microphones and associated preamplifiers within the microphone array which better reflect actual component parameters than factory measured values which are typically coded into conventional microphone arrays or audio processing software.

In general, the integral self-calibration system is capable of automatically determining the frequency response, sensitivity and gain of the individual channels (microphone plus preamplifier) in the microphone array. Typically, the integral self-calibration system may be operated at any time that calibration of the microphone or microphones in the array is desired. Further, in other embodiments, the integral self-calibration system of the microphone array operates automatically either upon connection to an external computing device, upon regular or user-specified intervals, or simply upon command.

In general, the integral self-calibration system operates by automatically injecting an excitation pulse of a known magnitude and phase to all preamplifier inputs within the microphone array. Note that the duration of the pulse should be larger than the preamplifier step response so as to avoid or minimize any effects resulting from transient responses. The resulting analog waveform from each preamplifier output is then measured. A frequency analysis, such as, for example, a Fourier or Fast Fourier Transform (FFT), or other conventional frequency analysis, of each of the resulting waveforms is then performed. The results of this frequency analysis are then used to compute frequency-domain compensation gains (e.g., magnitude and phase gains) for each preamplifier for matching or balancing the responses of all of the preamplifiers with each other.

Once computed, these frequency-domain compensation gains can then be applied to the output of each corresponding preamplifier when processing actual audio inputs of the microphones associated with each preamplifier. This serves to make the output from each of the preamplifiers consistent, given the same or similar input to any of the microphones in the array. Consequently, using these computed frequency-domain compensation gains, audio processing software such as, for example, software for performing sound source localization, beam forming, acoustic echo cancellation, noise suppression, etc., can easily compensate for phase response mismatches across all preamplifiers. Without this compensation, any phase response mismatches would reduce the performance of the audio processing software.

Therefore, as a result of computing and providing these frequency-domain compensation gains for each preamplifier, there is no need to use expensive matched electrical components. Further, inexpensive generic microphones and preamplifier combinations can have gain differences on the order of about ±4 dB or more due to manufacturing variances. Consequently, one advantage offered by the integral self-calibration system described herein is that microphone arrays using this integral self-calibration system may be inexpensively produced by using relatively inexpensive non-matched electrical components including, for example, microphones, preamplifiers, transistors, capacitors, resistors, op amps, etc.

2.1 System Overview:

The integral self-calibration system described herein is applicable for use with most types of microphones or microphone arrays. Further, in one embodiment, the integral self-calibration system is included in a "self-descriptive microphone array," as described in a copending patent application entitled "SELF-DESCRIPTIVE MICROPHONE ARRAY," having a filing date of 9 Feb. 2004, and assigned application Ser. No. 10/775,371, the subject matter of which is incorporated herein by this reference. In this embodiment the injection of pulses, readings of the preamplifier outputs, and computation of the frequency analysis, are all performed by driver software residing in the external computing device connected to the microphone array.

In particular, in this embodiment, the frequency analysis for computing the frequency-domain compensation gains for each preamplifier is performed by an external computing device, such as a PC-type computer, or other computing device, coupled to the microphone array via a conventional computer interface. One advantage of this embodiment is that because the microphone array makes use of external processing power, there is no need to include relatively expensive onboard signal processing software or hardware capabilities within the array itself. Consequently, the self-descriptive microphone array is relatively inexpensive to manufacture in comparison to conventional microphone array devices that include onboard audio processing capabilities. Note that the connection between the self-descriptive microphone array and the external computing device is accomplished using any of a variety of conventional wired or wireless computer interfaces, including, for example, serial, parallel, IEEE 1394, USB, IEEE 802.11, Bluetooth™, etc.

In another embodiment, as described in the aforementioned copending patent application entitled "SELF-DESCRIPTIVE MICROPHONE ARRAY," the microphone array further includes a "microphone array memory" that is integral to the microphone array. This microphone array memory includes any type of non-volatile memory, such as, for example a ROM, PROM, EPROM, EEPROM, or other conventional non-volatile memory type or device, which contains a microphone array device description. This device description includes parametric information, including the computed frequency-domain compensation gains for each preamplifier, which defines operational characteristics and configuration of the microphone array. The microphone array device description within the microphone array memory is then automatically updated, whenever the integral self-calibration system is activated, to reflect actual configuration of particular elements of the microphone array. In operation, the device description of the microphone array is then automatically reported to the external computing device via a microphone array interface (i.e., the conventional computer interface, as noted above).

In this embodiment, once the microphone array device description is provided to the external computing device, the external computing device then uses the device description to automatically configure audio processing software residing within the external computing device for processing one or more audio signals captured by the microphone array. Specifically, software applications residing within the external computing device, such as DLL's or other software drivers or programs, interpret physical parameters of the microphone array, including the frequency-domain compensation gains, that are provided by the microphone array device description. These software applications then communicate the physical parameter data of the microphone array to signal processing software residing within the external computing device. This allows the signal processing software to automatically adjust its operational parameters to the characteristics of the attached microphone array to perform automatically optimized audio processing computations.

As noted above, preamplifiers are associated with each microphone in the microphone array. Further, to allow for multiple simultaneous channels of audio to be captured by the microphone array, one or analog-to-digital (A/D) converters are also associated with each microphone. Audio signals captured by the microphone array are then pre-amplified (i.e., gain) and converted to a digital signal via the A/D converters and provided, via the aforementioned wired or wireless computer interface, to the audio processing software residing within the external computing device for further processing, as desired. The maximum number of digital audio channels that can then be transmitted via the computer interface is then only limited by the maximum bandwidth of that computer interface in combination with the digital sampling rate of each channel of the microphone array.

In another embodiment, in addition to including one or more microphones, the microphone array also includes one or more loudspeakers for reproducing one or more audio signals. For example, many microphone arrays, such as those arrays used for audio conferencing, frequently include both microphones and speakers. The microphones capture sound, and the speakers play back sound. Generally, conventional audio conferencing-type microphone arrays also include relatively expensive onboard acoustic echo cancellation capabilities so that local audio signals are not endlessly echoed during an audio conference. However, in the context of the aforementioned "self-descriptive microphone array," audio processing, such as acoustic echo cancellation, is performed via the audio processing software residing within the external computing device. Audio to be played back via the self-descriptive microphone array is then simply transmitted from the external computing device to the array via the aforementioned wired or wireless computer interface.

In this embodiment, as with the parametric information defining the microphones and preamplifiers within the microphone array, parametric information defining the speakers within the microphone array is also stored within the microphone array memory. Configuration of the microphone array is then reported, as noted above, to allow for automatic configuration of the audio processing software residing within the external computing device to which the microphone array is connected.

Figure 2:
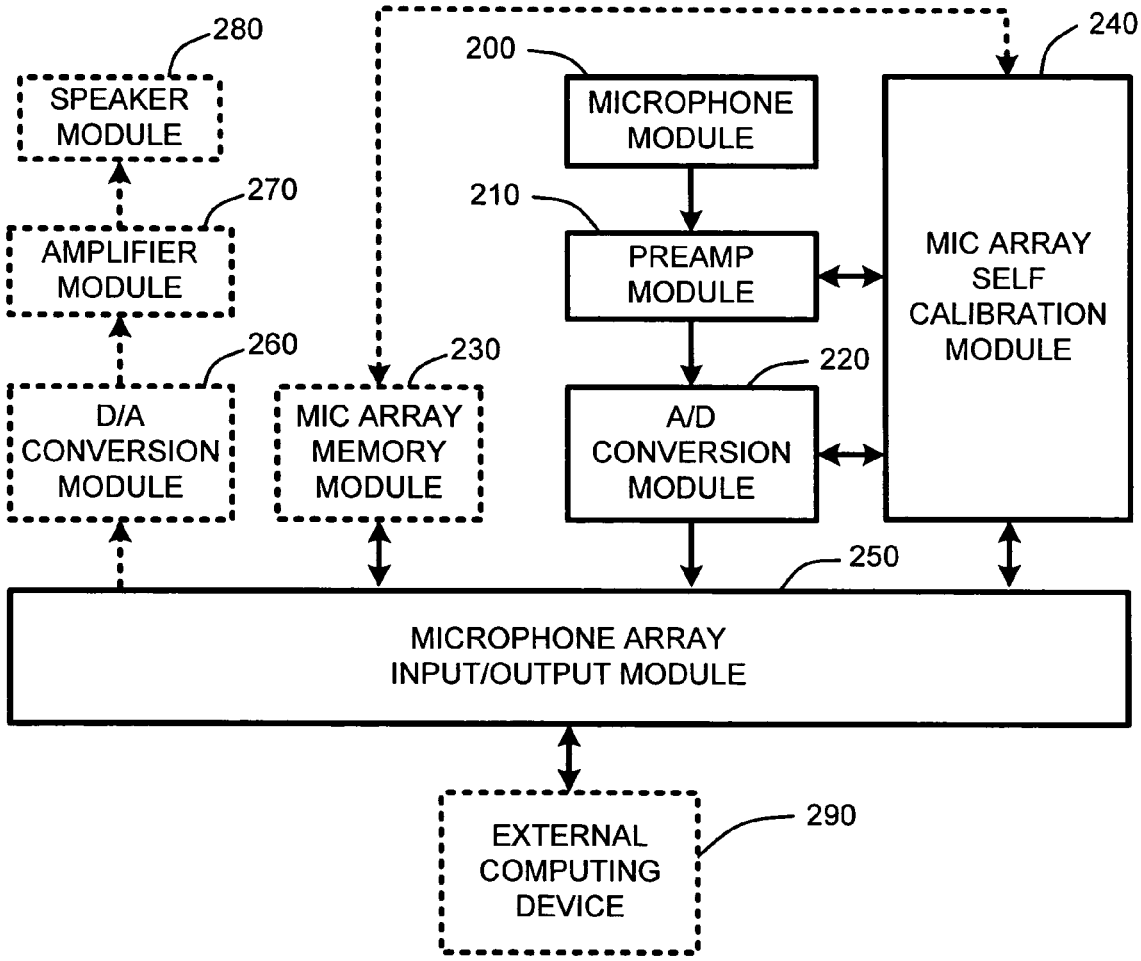
FIG. 2 illustrates an exemplary system diagram showing exemplary hardware and software modules for implementing a microphone array.

2.2 System Architecture:

The processes summarized above are illustrated by the general system diagram of FIG. 2. In particular, the system diagram of FIG. 2 illustrates the interrelationships between hardware and software modules for implementing an integral self-calibration system for a microphone array. It should be noted that any boxes and interconnections between boxes that are represented by broken or dashed lines in FIG. 2 represent alternate embodiments of the integral self calibration system and the microphone array described herein, and that any or all of these alternate embodiments, as described below, may be used in combination with other alternate embodiments that are described throughout this document.

In general, the microphone array includes a microphone module 200 comprising one or more microphones, such as, for example, conventional electret microphones, along with circuitry for amplifying analog audio signals captured by the microphone module 200, and for converting the analog signals to a digital format. In particular, amplification of captured signals is provided by a preamp module 210 comprising one or more preamplifier circuits which provide gain for amplifying the captured audio signals. An A/D conversion module 220 then provides one or more A/D converters for converting analog signals captured by the microphones into digital signals for transmission to an external computing device 290 via a microphone array input/output module 250, which provides for conventional data transmission via one of the aforementioned wired or wireless computer interfaces.

Further, in one embodiment, the microphone module 200, preamp module 210, and A/D conversion module 220, are combined into one module (not shown) in the case of microphones such as a MEMS microphone. For example, as is well known to those skilled in the art, a Micro-Electro-Mechanical-Structure (MEMS) type microphone is basically an integrated circuit, typically very small in size, which includes a microphone and preamplifier, and in some cases, A/D conversion within a single circuit or microchip. The use of MEMS-type microphones in the microphone array described herein allows for a further reduction in components by using an integrated circuit which combines each of the preamp module 210, A/D conversion module 220, and microphone module 200 into one module which then provides the operational capability of the three separate modules. Consequently, because the same functionality is provided by a MEMS-type microphone as is provided by use of the separate modules, i.e., the microphone module 200, preamp module 210, and A/D conversion module 220, the microphone array will be described in the context of these three modules. However, it should be understood that the use of MEMS-type microphone technology is inherent in the description of these three modules.

In addition, as noted above, the microphone array also includes an integral self-calibration system. This self calibration is embodied in a "microphone array self-calibration module" 240. As described in greater detail below in Section 3, this self-calibration module 240 injects one or more pulses of known magnitude and phase into an input of each preamplifier in the microphone array. The output response from each preamplifier is then measured and used to compute the frequency-domain compensation gains for each preamplifier.

Further, as described in the aforementioned copending patent application entitled, "SELF-DESCRIPTIVE MICROPHONE ARRAY," one embodiment of the microphone array includes a "microphone array memory module" 230 which stores and reports parametric information which defines operational characteristics and configuration of the microphone array, including the computed frequency-domain compensation gains for each preamplifier. In general, the memory module 230 uses any type of conventional non-volatile memory or storage, such as, for example, ROM, PROM, EPROM, EEPROM, etc. The parametric information stored within the memory module 230 is then reported to an external computing device 290, either upon connection of the microphone array to the external computing device, or upon a manual or automatic request for the information originating with the external computing device. As described herein, reporting of this parametric information allows for automatic configuration of audio processing software residing within the external computing device 290 for processing audio signals either captured by the microphone array, or in one embodiment, audio signals that are to be played back by one or more loadspeakers residing within the microphone array.

In one embodiment, the parametric information stored in the microphone array memory module 230 is maintained in a lookup table which includes parametric information describing the configuration of the microphone array. In general, this lookup table, or other means of storage, includes one or more of the following elements of parametric information: 1) microphone array manufacturer, model, and version; 2) microphone types and position; 3) microphone array working volume (i.e., where the sound source is expected to be); 4) microphone gain calibration (i.e., the computed frequency-domain compensation gains for each preamplifier); and 5) speaker configuration for any speakers included in microphone array.

Further, also as noted above, one embodiment of the microphone array includes a set of one or more speakers. This embodiment also includes one or more digital-to-analog (D/A) converters and one or more amplifiers. In particular, in this embodiment, a D/A conversion module 260 provides one or more D/A converters for performing digital-to-analog conversion of one or more digital signals provided by the external computing device 290 via the microphone array input/output module 250. An amplifier module 270 then provides amplification of the converted analog signals. These analog signals are then provided to a speaker module 280 for playback. In particular, the speaker module 280 includes one or more speakers for reproducing the amplified analog audio signals. Again, in this embodiment, the microphone array memory module 230 further includes parametric information defining physical characteristics of the speakers within the microphone array.

3.0 Operation Overview:

The above-described hardware and software modules are employed for implementing the integral self-calibration system for the microphone array. As summarized above, this integral self-calibration system enables automatic computation of frequency-domain compensation gains of the microphone array to allow automatic configuration and optimization of audio processing software residing within the external computing device. The following sections provide a detailed discussion of the architecture (FIG. 3) and operation (FIG. 4) of the microphone array, and of exemplary methods for implementing the hardware and software modules described in Section 2. In addition, the following sections also include a detailed discussion of the operation of the integral self-calibration system and method (FIG. 5).

Figure 3:
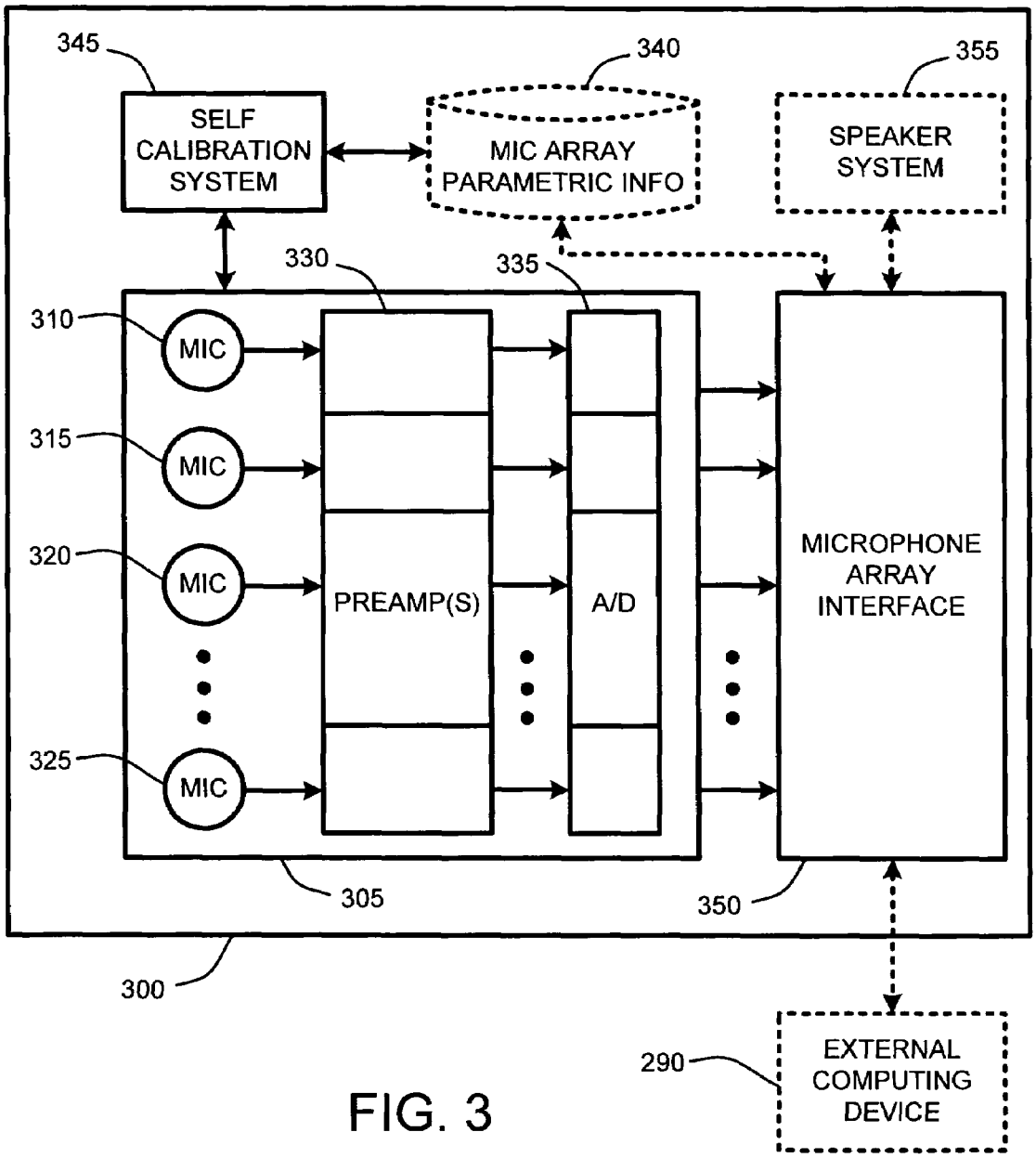
FIG. 3 illustrates an exemplary architectural layout of a hardware system embodying a microphone array.
Figure 4:
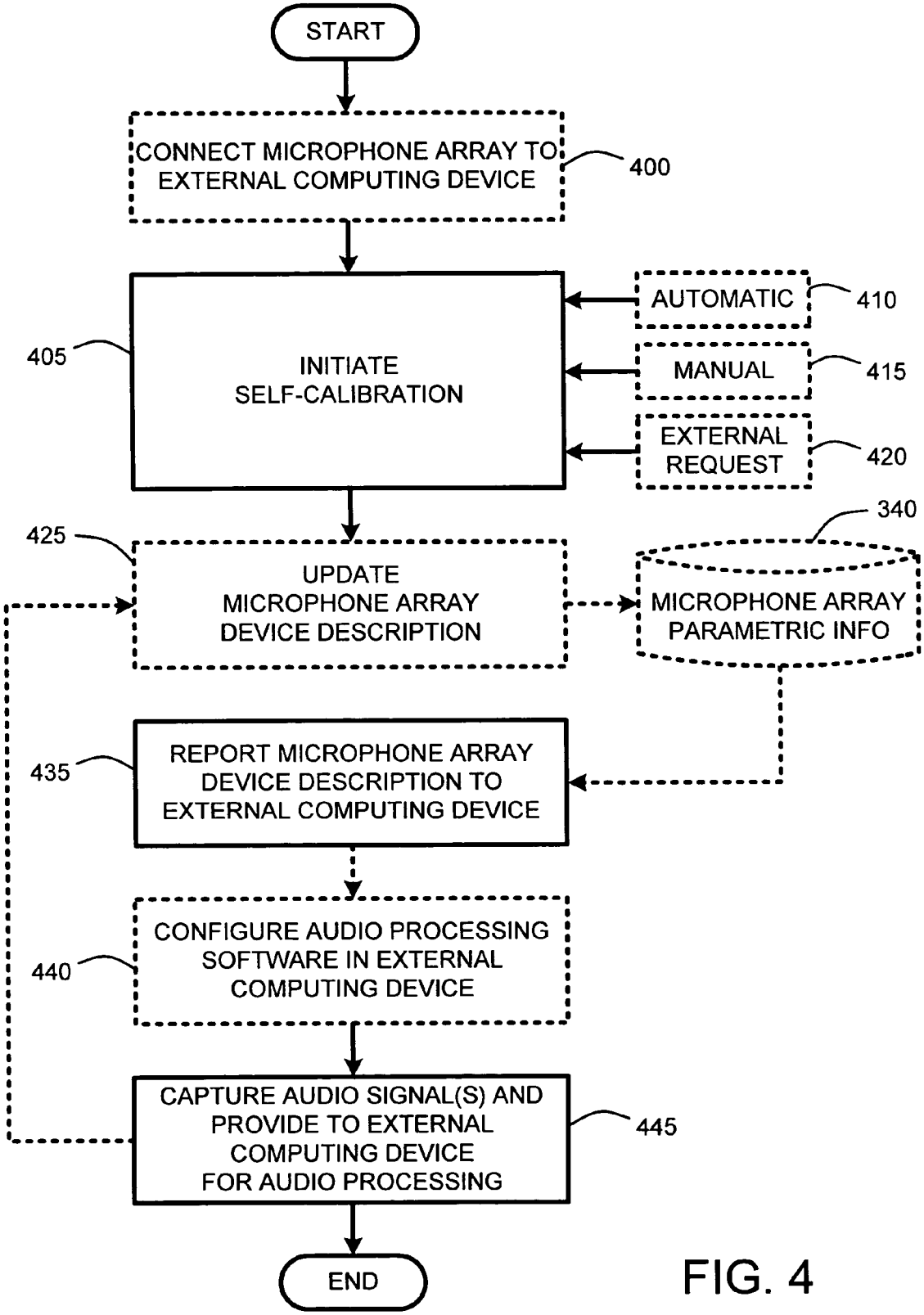
FIG. 4 provides an exemplary operational flow diagram which illustrates the operation of a microphone array having an integral self-calibration system.
Figure 5:
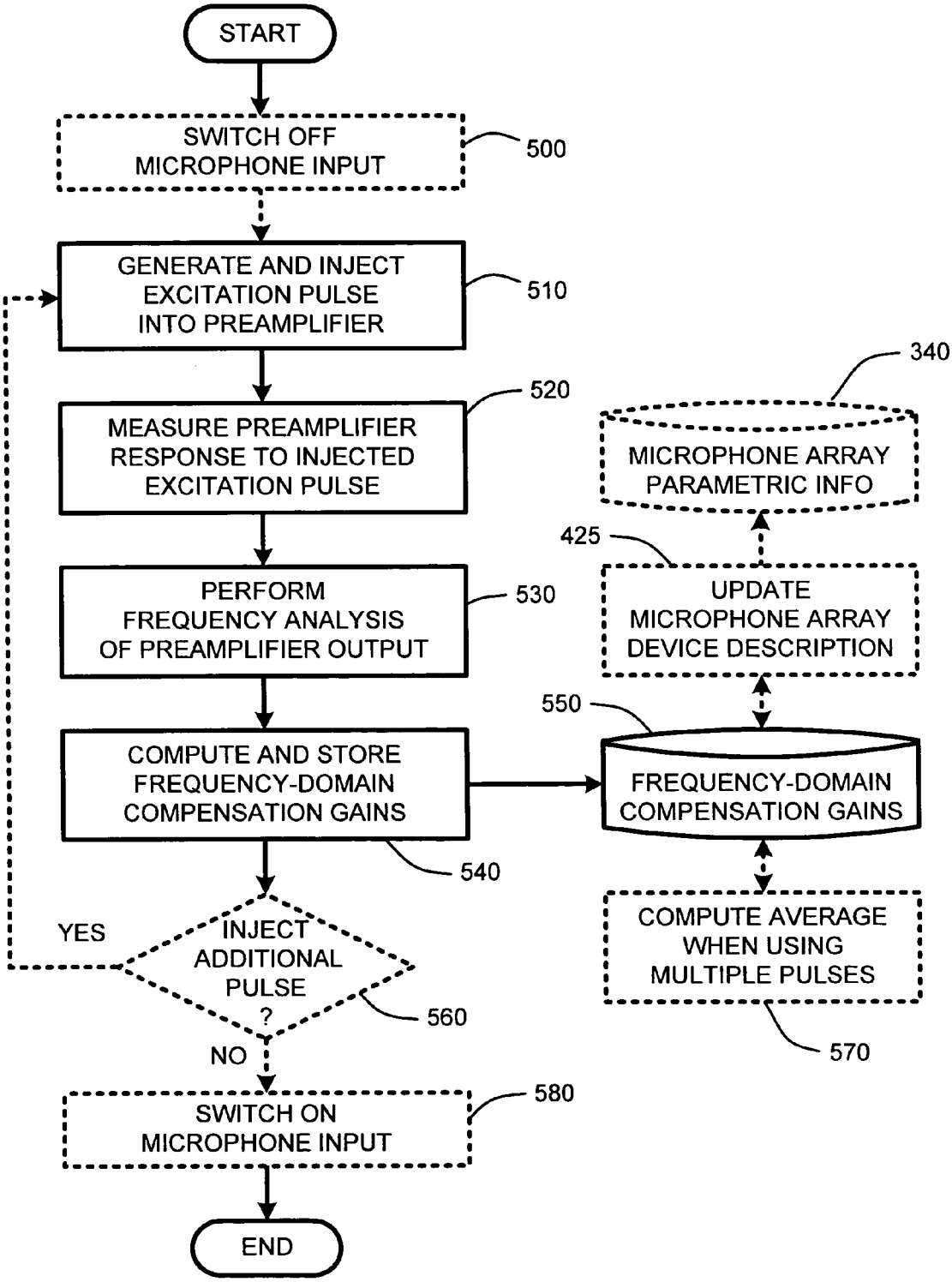
FIG. 5 provides an exemplary operational flow diagram which illustrates the operation of the integral self-calibration system of FIG. 4.

It should be noted that any boxes and interconnections between boxes that are represented by broken or dashed lines in any of FIG. 3, FIG. 4, or FIG. 5, represent alternate embodiments of the integral self-calibration system and the microphone array described herein, and that any or all of these alternate embodiments, as described below, may be used in combination with other alternate embodiments that are described throughout this document.

3.1 Microphone Array Architecture:

The processes described above with respect to FIG. 2 are illustrated by the general architectural diagram of FIG. 3. In particular, FIG. 3 illustrates an exemplary architectural layout of hardware representing one embodiment of the microphone array. For example, as illustrated by FIG. 3, a microphone array 300 comprises an array 305 of one or more microphones (310 through 325). Further, the array 305 of microphones included in the microphone array 300 also includes one or more preamplifiers 330 for providing gain or preamplification of each microphone (310 through 325). In a related embodiment, the array 305 further includes one or more Analog-to-Digital (A/D) converters 335 for digitizing an analog audio input from each microphone (310 through 325). Note that both preamplifiers and A/D converters are well known and understood by those skilled in the art, and will not be described in detail herein.

In addition, as described in the aforementioned copending patent application entitled "SELF-DESCRIPTIVE MICROPHONE ARRAY," one embodiment of the microphone array 300 also includes a microphone array memory 340 which contains parametric information that defines operational characteristics and configuration of the microphone array. The microphone array 300 also includes at least one external interface 350, including, for example, serial, parallel, IEEE 1394, USB, IEEE 802.11, Bluetooth™, etc., for connecting the microphone array to an external computing device 290.

As noted above, the microphone array 300 also includes a self calibration system 345 which automatically determines a current state of one or more of the components of the microphone array. This current state is then used to automatically update one or more of the operational characteristics stored in the microphone array memory 340. For example, in one embodiment, the self calibration system 345 automatically measures preamplifier 330 impulse responses. In general, this determination is made by providing a "pulse injection circuit" for injecting a precise low-amplitude pulse of known magnitude and phase at the input of each preamplifier 330. The precise impulse response of each preamplifier 330 is then measured for computing frequency-domain compensation gains for each preamplifier. These computed frequency-domain compensation gains then serve to provide a consistent output from each amplifier regardless of the operational characteristics of each microphone/preamplifier combination. Repeating this process for each preamplifier and storing the resulting preamplifier 330 frequency-domain compensation gains in the microphone array memory 340 allows for precise configuration of audio processing software residing on the external computing device 290 using the frequency-domain compensation gains for each preamplifier.

One clear advantage of this embodiment is that by knowing a precise frequency-domain compensation gain for each preamplifier 330, software drivers associated with audio processing software residing on the external computing device 290 can then easily compensate for phase response mismatches across all preamplifiers. Without compensation, such mismatches would reduce the performance of certain audio processing applications. For example, the performance of conventional beamforming or sound source localization (SSL) digital signal processing software, which combines all microphone signals to provide a relatively narrow capture direction selectivity, will be significantly improved by compensating for the precise phase response of each preamplifier 330. Note that the self calibration system 345 for the microphone array 300 is described in further detail below in Section 3.2.1 with respect to FIG. 5, and in the working example provided in Section 4 with respect to FIG. 6 through FIG. 13.

Finally, in yet another embodiment, the microphone array 300 includes a loadspeaker system 355. In general, this speaker system 355 includes one or more speakers, one or more D/A converters, and one or more amplifiers for amplifying analog audio signals prior to playback by the speakers included in the speaker system. In this embodiment, audio signals provided by the external computing device 290 via the microphone array interface 350 are first converted to analog signals, amplified, and then reproduced by providing the amplified analog audio signals to the speakers of the speaker system 355.

3.2 Microphone Array Operation:

In one embodiment, as illustrated by FIG. 4, the microphone array described above operates by first connecting the microphone array to the external computing device (Box 400). As noted above, this connection is accomplished using a conventional wired or wireless computer interface, such as, for example, serial, parallel, IEEE 1394, USB, IEEE 802.11, Bluetooth™, etc., for connecting the microphone array to the external computing device.

In one embodiment, once connected, self-calibration (Box 405) of the microphone array is initiated. In a tested embodiment, this self-calibration is performed automatically (Box 410) as soon as the microphone array is connected to the external computing device (Box 400). In a related embodiment, the self-calibration is performed immediately upon manual user request (Box 415), said request being provided from the external computing device via the computer interface. In another related embodiment, the self-calibration is performed immediately upon an external request (Box 420), such as, for example, a request generated by one an audio processing software program operating on the external computing device. Again, as with the manual request (Box 415), the external request (Box 420) is provided from the external computing device via the computer interface. In each of these embodiments, i.e., automatic, manual, or externally requested self-calibration, the microphone array device description automatically updates (Box 425) the microphone array parametric information 340 to reflect the current state of the microphone array as determined via the self-calibration procedure described in detail in Section 3.2.1.

At this point, the parametric information 340 defining the current state of the microphone array is reported (Box 435) to the external computing device. As noted above, given the known operational characteristics of the components of the microphone array (i.e., microphone, speakers, preamps, etc.), audio processing software operating within the external computing device is automatically optimized and/or configured (Box 440) to provide a computing environment that is specifically tailored to the known parameters of the microphone array connected to the external computing device.

For example, assuming a microphone array with two microphones, where one of the microphone channels has a gain of +4 dB more than the other microphone channel, the input received by either or both of the microphones is then weighted by a factor designed to compensate for this difference in gain so that the input provided by either of the microphones will be nominally equivalent. As a result of such adjustments, conventional processing of audio captured by the microphone array is significantly improved relative to audio processing without weighting the audio inputs to reflect actual microphone array configurations.

Once the audio processing software has been optimally configured, one or more audio signals are captured by the microphone array and provided to the external computing device, via the aforementioned computer interface, for audio processing, as desired (Box 445). Such processing may include, for example, conventional sound source localization, beam forming, acoustic echo cancellation, noise suppression, etc. Note that as such audio processing techniques are well known to those skilled in the art, they will not be described in detail herein. Finally, in one embodiment, the device description including the microphone array parametric information 340 is updated at any time during the above-described processes by requesting a self-calibration, either manually, or via an external request, as described below.

3.2.1 Microphone Array Self-Calibration:

As noted above, the microphone array includes an integral self-calibration system. In general, this integral self-calibration system is intended to compensate for using relatively inexpensive non-matched electronic components in the construction of the microphone array by automatically determining frequency-domain responses of each preamplifier in the microphone array, and then computing frequency-domain compensation gains for matching the output of each preamplifier. However, this same self-calibration system also serves to compensate for any changes in the electrical properties of the preamplifier circuits in the microphone array as a result of temperature or age related effects on the electrical components in the array.

As noted above, in one embodiment, each of the microphones remain live for receiving audio signals during injection of the excitation pulse into each preamplifier. Conversely, in one embodiment, as illustrated by FIG. 5, the integral self-calibration system begins operation by first switching off each microphone input to each corresponding preamplifier (Box 500). However, it should be noted that, as discussed below, this step may be omitted, especially in the case where the output of multiple pulses is averaged and used for computing the frequency-domain compensation gains for each preamplifier.

Next, whether or not the microphones remain live, an excitation pulse of known magnitude and phase is automatically generated by a "preamplifier pulse test circuit" and injected into each preamplifier (Box 510). As is well known to those skilled in the art, there are a large number of methods for generating a pulse of known magnitude and phase for a given period of time. Consequently, rather than providing an exhaustive list of such methods, one such method, as used in the tested embodiment of the working example described in Section 4, will be discussed. However, it should be understood that the particular pulse generation method described below is not intended to limit the scope of the integral self-calibration system described herein, and is provided for purposes of explanation only.

Figure 7:
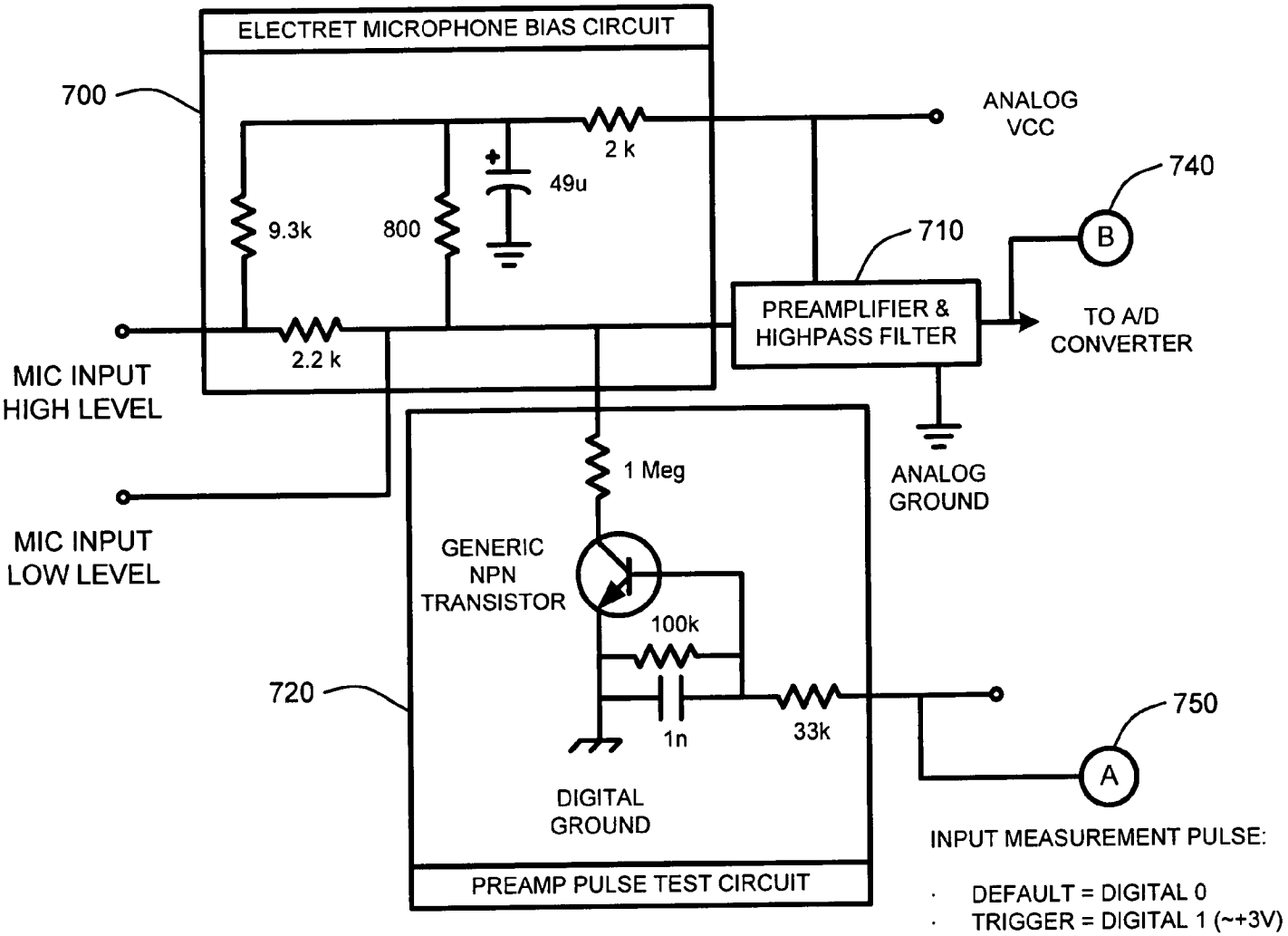
FIG. 7 provides an exemplary circuit diagram for a pulse injection circuit for the integral self-calibration system of FIG. 6.

For example, as discussed in further detail with respect to the working example provided in Section 4 with respect to FIG. 7, in one embodiment, the excitation pulse is generated using a "preamplifier pulse test circuit" which generates a low amplitude pulse of a predetermined duration. In this tested embodiment, the preamplifier pulse test circuit includes a conventional NPN-type transistor which simply acts as an open switch until a voltage corresponding to a digital "1" (i.e., approximately 3 volts) is applied to the preamplifier pulse test circuit. Once this voltage is applied, the NPN-type transistor switch closes and a low amplitude analog waveform pulse (i.e., the excitation pulse) is generated by the preamplifier pulse test circuit. This excitation pulse is generated for as long as the NPN-type transistor switch is closed (i.e., for as long as the voltage corresponding to a digital "1" continues to be applied). Note that the period of the excitation pulse should be longer than the preamplifier step response. For example, given a preamplifier step response duration of approximately 30 ms, an excitation pulse on the order of about 50 ms was found to provide sufficient frequency-domain information to compute the frequency-domain compensation gains for each preamplifier.

Once the excitation pulse generated by the preamplifier pulse test circuit is input into each of the preamplifiers in the microphone array, each preamplifier then amplifies the low-amplitude excitation pulse injected from the preamplifier pulse test circuit to output a high-amplitude voltage waveform. Each preamplifier output is then measured (Box 520) by simply recording the actual output level of each preamplifier. Note that in one embodiment, conventional A/D converters are used to convert each analog preamplifier response to a set of digital values (see for example FIG. 2 and FIG. 3, and the corresponding A/D conversion discussion). These digital values are then simply recorded.

A frequency analysis of at least part of the preamplifier output resulting from the excitation pulse is then performed (Box 530). For example, a conventional FFT-type frequency analysis will provide magnitude, frequency and phase information for the resulting preamplifier output. Clearly, as should be appreciated by those skilled in the art, there are a number of well-known conventional methods for determining frequency-domain information from a signal. However, for purposes of clarity of discussion, the discussion of the frequency analysis will assume an FFT analysis of the preamplifier responses.

Given the FFT analysis of each preamplifier output, frequency domain compensation gains are then computed (Box 540) for each preamplifier. In particular, because the exact frequency-domain response of each preamplifier is known, it is a simple matter to compute frequency-domain magnitude and phase gains for each individual preamplifier, such that the magnitude frequency-domain response of all of the preamplifiers will be closely matched once the gains computed for each individual preamplifier are applied to the output of each individual preamplifier. The computed frequency domain compensation gains for each preamplifier are then stored in a table or array 550 of frequency domain compensation gains that is then made available for use by audio processing software.

In addition, as noted above, in one embodiment, the microphone array parametric information is stored in the microphone array memory 340 (see FIG. 2 and FIG. 3) which contains parametric information that defines operational characteristics and configuration of the microphone array. In this embodiment, the computed frequency domain compensation gains are used to update the microphone array device description 425 by storing the computed frequency domain compensation gains in the microphone array memory 340.

At this point, a determination is made as to whether additional excitation pulses are to be injected into the preamplifiers (Box 560). For example, as discussed above, in one embodiment, multiple pulses are injected into the preamplifiers. As a result, each preamplifier will have a computed frequency domain compensation gain for each pulse. In this embodiment, the computed frequency domain compensation gains for each preamplifier are simply averaged (Box 570). One advantage of using multiple pulses is that averaging of the frequency domain compensation gains tends to minimize any effects resulting from background noise or transients when the microphones are left live. Consequently, the microphone array can be constructed without microphone switching circuitry since there is no need to turn off the microphones for excitation pulse injection in this embodiment.

If additional excitation pulses are to be injected (Box 560), then the steps described above for the case of a single excitation pulse are simply repeated bor each additional excitation pulse. Alternately, if no additional; excitation pulses are to be injected into the preamplifiers, then, if the microphones have been switch off (Box 500) they are simply switched back on (Box 580). Self-calibration of the microphone array is complete at this point.

4.0 Working Example:

A tested embodiment of the microphone array with the integral self-calibration system and method is illustrated by FIG. 6 through FIG. 13. It should be noted that the following discussion and the associated figures are provided for purposes of explanation, and that the embodiments described with respect to FIG. 6 through FIG. 13 illustrate only one possible implementation of the system and method described herein.

Figure 6:
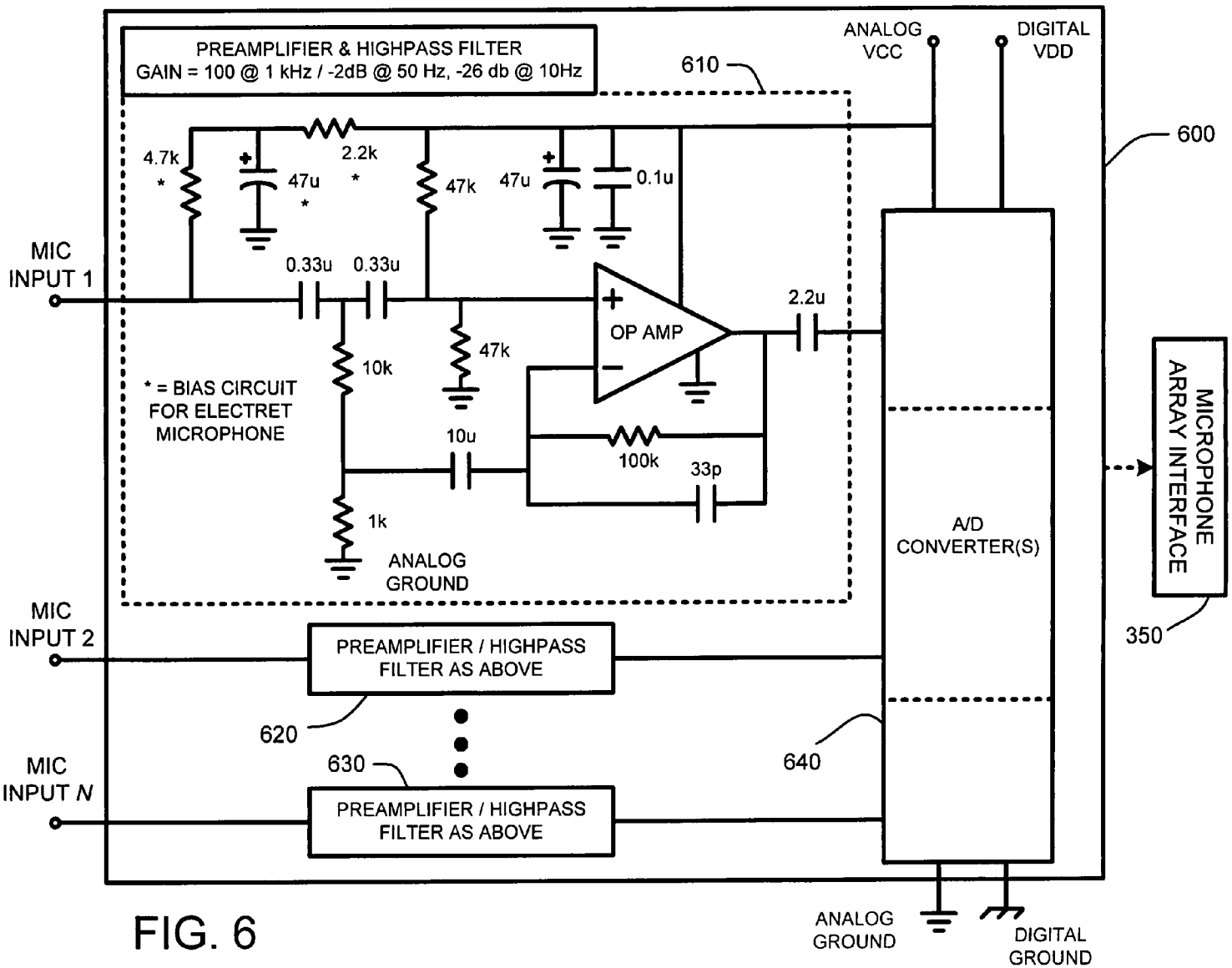
FIG. 6 provides an exemplary circuit diagram for the preamplifiers, highpass filter modules and analog-to-digital converters that comprise the analog subsystem of a microphone array having an integral self-calibration system.

In general, FIG. 6 provides an exemplary basic circuit diagram for a microphone array 00, as described herein. Specifically, as illustrated by FIG. 6, the microphone array 600 includes one or more input channels. Note that only three channels are illustrated (Mic 1, Mic 2, and Mic N), however, the microphone array can have as many channels as desired by simply repeating the circuit illustrated by Mic 1 (i.e., circuit 610). As noted above, each input channel comprises at least a microphone and a preamplifier circuit, 610, 620, or 630. Each input channel is nominally the same, however, as non-matched electrical components may be used in the construction of the microphone array, it is to be expected that each channel of the microphone array will have different operational characteristics. Consequently, as described above, the computed frequency domain compensation gains for each preamplifier are used to compensate for phase response mismatches between each channel.

The preamplifier circuit in FIG. 6 uses a configuration that allows a single operational amplifier (OP AMP) to provide both amplification and highpass filtering functions. Specifically, this exemplary circuit was designed to provide a third-order highpass frequency response to ensure that low frequencies (below a predetermined cutoff frequency, for example 50 Hz) are significantly attenuated. Such filtering serves to remove high-amplitude low-frequency noises that are often present in a meeting room environment (e.g., air flow in air conditioning vents, computer fans, etc.).

FIG. 6 also shows a set of A/D converters 640, one for each input channel (610, 620, and 630). As noted above, the A/D converters simply digitize the output of each channels preamplifier for transmission via the microphone array interface 350 to the external computing device for further processing.

FIG. 7 illustrates an extension to the basic circuit diagram of FIG. 6. In particular, FIG. 7 includes a modified bias circuit 700 and a preamplifier pulse test circuit 720 for generating and injecting the excitation pulse into each preamplifier 710 (also 610, 620, or 630 from FIG. 6). The modified bias circuit 700 allows the connection of an electret microphone with either high output signal level (such as omnidirectional microphones) or an electret microphone with low output signal level (such as unidirectional microphones).

In general, the pulse injection circuit 720 in FIG. 7 uses a conventional NPN-type bipolar transistor as an analog "switch." In particular, controlled by a digital pulse, as described below, the pulse injection circuit 720 injects a low-amplitude analog pulse at the input of the preamplifier 620. This allows a software driver residing on the aforementioned remote computing device to trigger the excitation pulse (via the computer interface to the microphone array) and to measure the response of the preamplifier to that pulse. In particular, in this tested embodiment, triggering the excitation pulse is accomplished by injecting a digital "1", approximately +3V, at point A (750) which triggers the NPN-type transistor to close the "switch." As a result of closing this switch, the excitation pulse is generated by the preamplifier pulse test circuit 720 and provided to the preamplifier 710. As described above, a conventional A/D converter is then used to measure the response of the preamplifier 710 output at point B 740.

In particular, as noted above, to measure the frequency response of all preamplifiers, the software driver forces a digital pulse signal through point A 750 in the circuit illustrated in FIG. 7. That pulse is obtained from one of the pins in the computer interface between the remote computing device and the microphone array. The preamplifier pulse test circuit, with a single NPN transistor and a few discrete components, acts as an analog switch controlled by the digital pulse in point A 750. The voltage at point A is nominally at digital "0" (near 0 V), so that the transistor is effectively an open switch, and does not interfere with normal operation of the preamplifier. During the pulse, the voltage at A it is momentarily (typically for 50 milliseconds) brought to digital "1" (near 3V). During that "1" pulse, the transistor effectively closes, generating a very low amplitude pulse at the preamplifier input 710 (note that the microphone elements don't need to be disconnected from the input, as discussed herein). The preamplifier 710 then amplifies that low-amplitude pulse at its input, and generates a high-amplitude voltage waveform at point B 740. That waveform is digitized by the A/D converter, and read out by the software driver.

Figure 8:
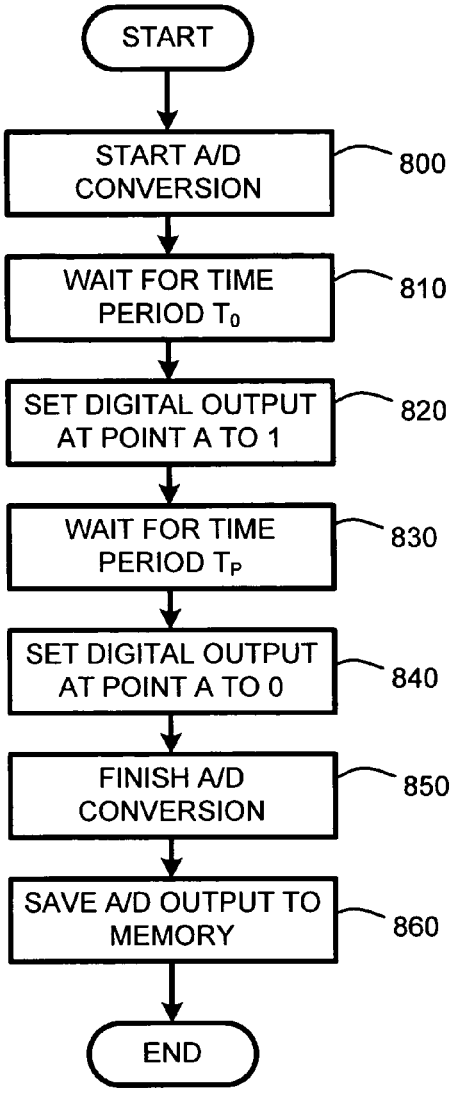
FIG. 8 provides an exemplary operational flow diagram for injecting an excitation pulse into a preamplifier and measuring the preamplifier output for the pulse injection circuit of FIG. 7.

For example, FIG. 8 provides an exemplary operational flow diagram for injecting an excitation pulse into a preamplifier and measuring the preamplifier output for the pulse injection circuit of FIG. 7. In particular, given the output of the preamplifier as a result of the excitation pulse, A/D conversion is initialized 800 to provide a digital measurement of the magnitude of the preamplifier response as a function of time. The system then waits a short time period, $T_0$, 810 on the order of about 2 ms or so to ensure that the A/D conversion has been fully initialized. At this point, a digital "1" is applied 820 to point A of the preamplifier pulse test circuit illustrated in FIG. 7. As discussed above, this digital "1" serves to close the NPN transistor acting as an analog switch and to generate the excitation pulse that is then provided to the preamplifier.

The application of the digital "1" is continued for a period of time $T_P$ 830. This time period, $T_P$, represents the excitation pulse duration, and is a predetermined period that is larger than the duration of the preamplifier step response. In this tested embodiment, the preamplifier step response was approximately 30 ms. Consequently, in this tested embodiment, $T_P$ was set to 50 ms. Once the time period Tp has passed, the digital "1" is removed from point A of the preamplifier pulse test circuit illustrated in FIG. 7, and a digital "0" is instead applied at this point. As discussed above, this digital "0" serves to open the NPN transistor acting as an analog switch and to terminate the generation of the excitation pulse provided to the preamplifier. Once this digital "0" is applied, A/D conversion of the preamplifier response to the excitation pulse is finished 850, and the resulting digitized response values are stored 860 for use in the aforementioned frequency-domain analysis of the preamplifier response.

Figure 9:
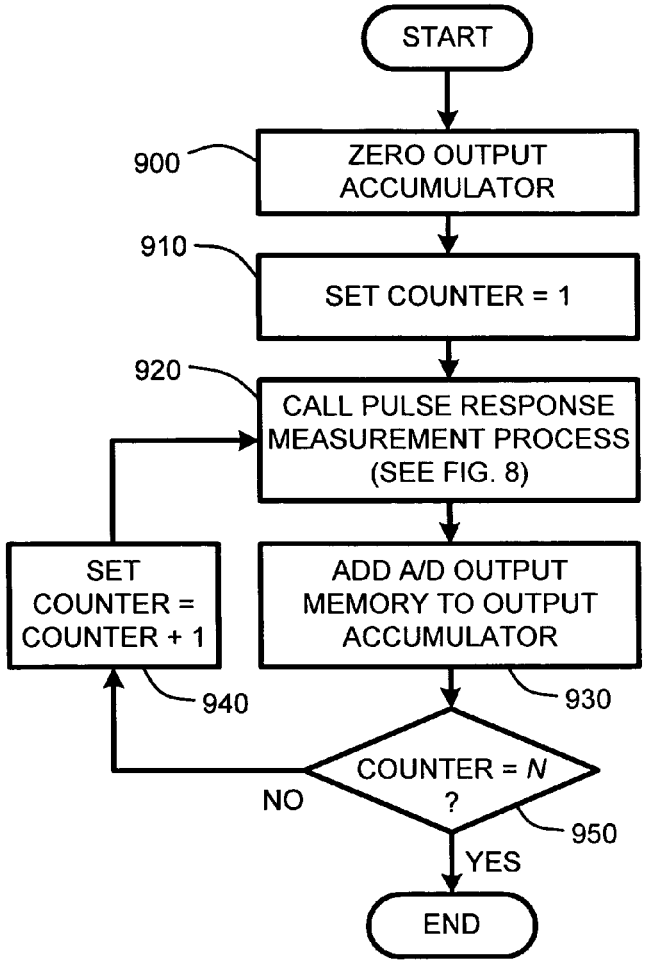
FIG. 9 provides an exemplary operational flow diagram which illustrates the collection of preamplifier outputs from a predetermined number of input excitation pulses for the preamplifier output measurement flow diagram of FIG. 8.
Figure 10:
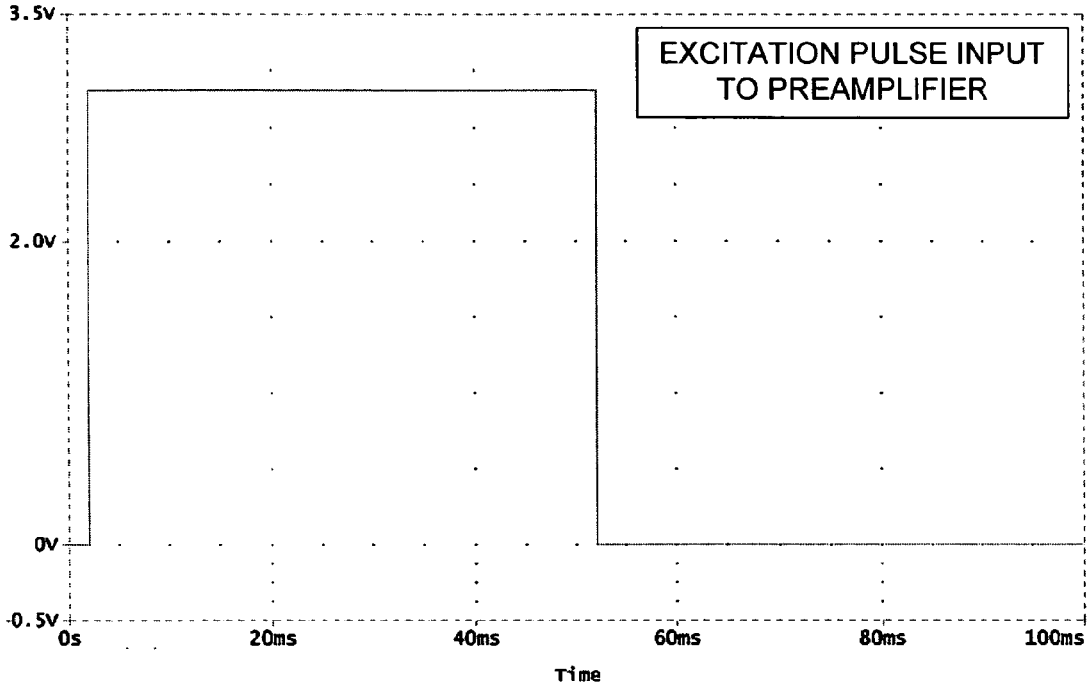
FIG. 10 is a graph which illustrates an exemplary excitation pulse input to a preamplifier.

FIG. 9 builds on the basic single pulse flow diagram of FIG. 8 by providing for the accumulation of the preamplifier outputs to multiple pulses. In particular, since each measurement takes only about 100 ms, as shown in FIG. 10, during a period of, for example, 5 seconds, the software driver can make a set of N=50 measurements. The software driver then adds the results of all those measurements to an accumulator, as illustrated by steps 900 through 950 of the flow diagram of FIG. 9. As discussed above, the accumulated preamplifier response values are then averaged and used for computing the frequency-domain compensation gains for matching the output of each preamplifier. Averaging N measurements effectively filters out noises or other transients that might disturb the measurement. As noted previously, there is no need to disconnect or switch off the microphones in the array during the preamplifier response measurements. In particular, since each measurement generates different noise patterns, averaging N measurements with N large enough (e.g. 50 measurements) reduces the effects of such noises to negligible levels.

Figure 11:
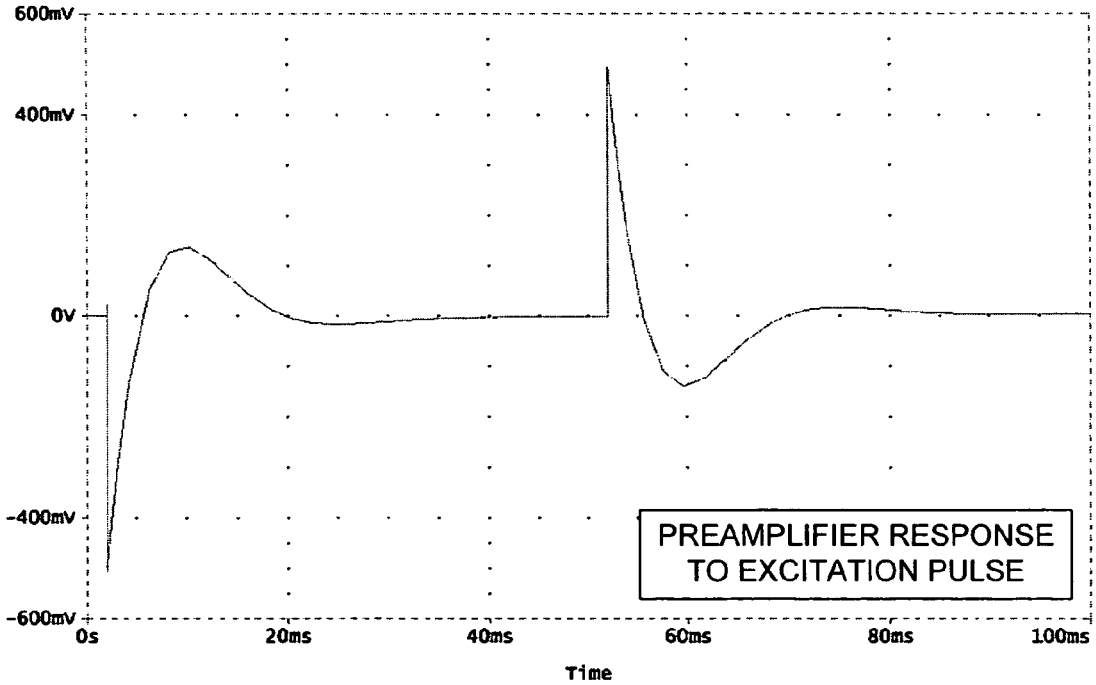
FIG. 11 is a graph which illustrates a typical preamplifier output response to the exemplary excitation pulse of FIG. 10.

FIG. 10 shows the typical waveforms at point A (pulse driving digital input) while FIG. 11 shows a typical preamplifier analog output at point B of the general circuit diagram of FIG. 7. Note that in this tested embodiment, it can be seen that the highpass filtering response of the preamplifier has significantly attenuated the flat portion of the pulse in the preamplifier analog output at point B. This is typical behavior for such highpass filtering. Note that the second pulse of the preamplifier output response at point B (at approximately 52 ms, and having a sharp positive attack and a small negative sidelobe) is the preamplifier step response that is actually used in the aforementioned frequency-domain analysis. From that portion of the response, the frequency response of the preamplifier is easily computed by applying an FFT to that waveform.

Figure 12:
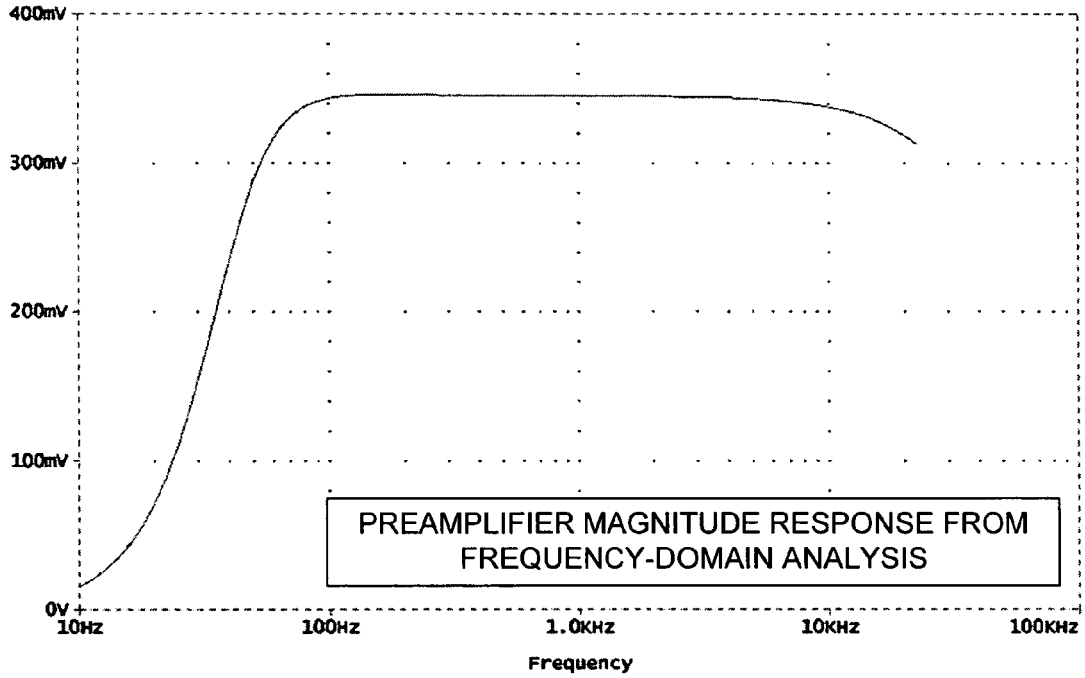
FIG. 12 is a graph which illustrates a typical preamplifier output magnitude response computed from a frequency-domain analysis of the preamplifier output of FIG. 11.
Figure 13:
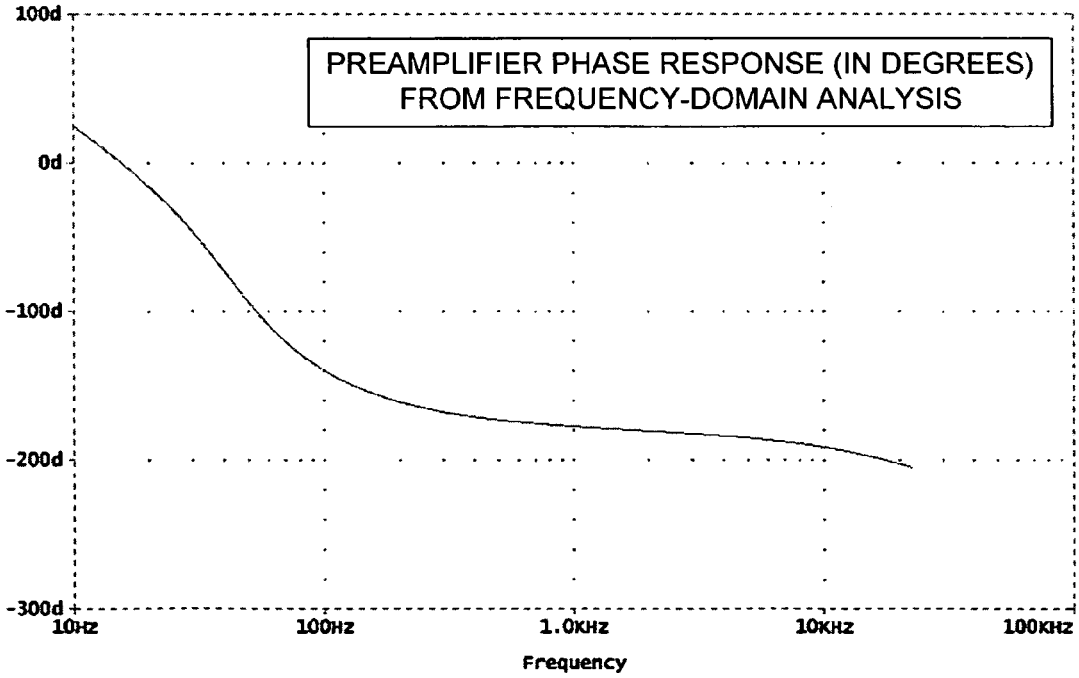
FIG. 13 is a graph which illustrates a typical preamplifier output phase response (in degrees) computed from a frequency-domain analysis of the preamplifier output of FIG. 11.

In general, FIG. 12 illustrates the results of a frequency-domain analysis of the preamplifier output waveform of FIG. 10. In particular, FIG. 12 illustrates a typical magnitude response of the preamplifier. Similarly, FIG. 13 illustrates the phase response, with "d" indicating degrees, as determined by the frequency-domain analysis of the preamplifier output of FIG. 10. Specifically, FIG. 12 and FIG. 13 show the results of an FFT analysis of the pulse response output signal of FIG. 10. These figures indicate both the amplitude and phase responses at each frequency. As noted above, the aforementioned software driver computes those responses for all preamplifier channels, and stores them in tables, allowing a precise compensation of any differences in responses among channels.

The foregoing description of the self-calibration system and method for automatically determining frequency-domain compensation gains for each preamplifier in a microphone array has been presented for the purposes of illustration and description. It is not intended to be exhaustive or to limit the invention to the precise form disclosed. Many modifications and variations are possible in light of the above teaching. Further, it should be noted that any or all of the aforementioned alternate embodiments may be used in any combination desired to form additional hybrid embodiments of the self-calibration system for the microphone array. It is intended that the scope of the invention be limited not by this detailed description, but rather by the claims appended hereto.

What is claimed is:

1. A system for automatically matching preamplifiers in a microphone array, comprising:

injecting at least one excitation pulse directly into each preamplifier in the microphone array;

measuring each preamplifier output response to each excitation pulse;

performing a frequency-domain analysis of the measured preamplifier output response to each excitation pulse; and computing frequency-domain compensation gains from the results of the frequency-domain analysis for matching the output of each preamplifier without consideration of the operational characteristic of a microphone in the microphone array coupled to each amplifier.

2. The system of claim 1 wherein two or more excitation pulses are injected into each preamplifier in the microphone array, and wherein the measured preamplifier output response for each preamplifier is the average response to each excitation pulse.

3. The system of claim 1 wherein the microphone array further comprises a computer interface for connecting the array to an external computing device.

4. The system of claim 3 wherein the at least one excitation pulse is automatically generated by the microphone array in response to a pulse generation command from the external computing device via the computer interface.

5. The system of claim 3 wherein the microphone array further comprises an integral memory for maintaining a set of parameters defining operational characteristics of the microphone array.

6. The system of claim 5 wherein the set of parameters defining operational characteristics of the microphone array is automatically reported to the external computing device via the computer interface.

7. The system of claim 6 wherein the set of parameters defining operational characteristics of the microphone array includes information defining the computed frequency-domain compensation gains for each preamplifier in the array.

8. The system of claim 3 wherein the computer interface for connecting the array to the external computing device is any of a wired and a wireless computer interface.

9. A method for automatically matching preamplifier frequency-domain responses in a microphone array, comprising using a computing device to:

generate at least one analog excitation pulse of a predetermined phase, magnitude and duration and provide the at least one generated analog excitation pulse directly to an input of each preamplifier in a microphone array;

digitize an output resulting from each excitation pulse for each preamplifier in the microphone array;

perform a frequency-domain analysis of the digitized output for each preamplifier in the microphone array; and compute frequency-domain compensation gains from the results of the frequency-domain analysis for matching the output of each preamplifier in the microphone array with each other without consideration of the operational characteristic of a microphone in the microphone array coupled to each preamplifier.

10. The method of claim 9 wherein for each analog excitation pulse provided to the input of each preamplifier in a microphone array, the resulting digitized outputs are averaged, and wherein the averaged digitized output for each preamplifier is used to perform the frequency-domain analysis and to compute the frequency-domain compensation gains from the results of the frequency-domain analysis.

11. The method of claim 9 wherein the computed frequency-domain compensation gains are used to automatically configure audio processing software operating within an external computing device to reflect a current configuration of the microphone array, said microphone array being coupled to the external computing device via any of a wired and a wireless computer interface.

12. The method of claim 9 wherein the computed frequency-domain compensation gains are stored locally within the microphone array within a microphone array memory.

13. The method of claim 12 wherein the microphone array memory further includes information defining microphone types and geometry for each microphone in the microphone array, and a microphone array working volume for each microphone in the microphone array.

14. The method of claim 12 wherein the microphone array memory is a programmable memory, and wherein the information stored within the programmable memory in an addressable lookup table.

15. A system for automatically calibrating preamplifiers in a microphone array to provide matched preamplifier outputs, comprising:

a microphone array including at least one microphone, each microphone further including at least one preamplifier;

said microphone array further including a switchable pulse generation circuit for generating excitation pulses of a predetermined duration, magnitude and phase;

remotely initiating generation of at least one excitation pulse in the switchable pulse generation circuit from a remote computing device coupled to the microphone array via a computer interface;

automatically injecting each excitation pulses directly into each preamplifier;

measuring an output resulting from each injected excitation pulse for each preamplifier;

providing the measured output for each preamplifier to the remote computing device via the computer interface;

on the remote computing device, performing a frequency-domain analysis of the measured output for each preamplifier; and computing frequency-domain compensation gains from the results of the frequency-domain analysis for matching the output of each preamplifier in the microphone array with each other without consideration of the operational characteristic of a microphone in the microphone array coupled to each preamplifier.

16. The system of claim 15 wherein the measured output for each preamplifier is averaged with each other measured output for each individual preamplifier, and wherein the averaged output for each preamplifier is provided as the measured output for each preamplifier to the remote computing device via the computer interface.

17. The system of claim 15 wherein the microphone array further includes at least one addressable memory for storing operational parameters of the microphone array; and wherein the microphone array automatically reads the parametric information from the addressable memory and reports the parametric information to the remote computing device via a computer interface, said remote computing device being remotely coupled to the microphone array via the computer interface.

18. The system of claim 15 wherein the microphone array further includes a set of at least one speaker for reproducing one or more audio signals.

19. The system of claim 15 wherein the computer interface is any of a wired and a wireless computer interface.

20. The system of claim 15 further comprising automatically configuring audio processing software operating within the remote computing device to reflect the computed frequency-domain compensation gains for each preamplifier in the microphone array when processing audio signals being provided to the external computing device from the microphone array via the computer interface.

* * * * *